US010907895B1

(12) United States Patent
DiPietro

(10) Patent No.: US 10,907,895 B1
(45) Date of Patent: Feb. 2, 2021

(54) PORTABLE COOLING DEVICE

(71) Applicant: Jason DiPietro, East Providence, RI (US)

(72) Inventor: Jason DiPietro, East Providence, RI (US)

( * ) Notice: Subject to any disclaimer, the term of this patent is extended or adjusted under 35 U.S.C. 154(b) by 38 days.

(21) Appl. No.: 16/164,969

(22) Filed: Oct. 19, 2018

Related U.S. Application Data

(60) Provisional application No. 62/575,831, filed on Oct. 23, 2017.

(51) Int. Cl.
*F25D 31/00* (2006.01)
*F25D 3/00* (2006.01)

(52) U.S. Cl.
CPC ..... *F25D 31/007* (2013.01); *F25D 3/005* (2013.01)

(58) Field of Classification Search
CPC ..... F25D 31/007; F25D 31/008
See application file for complete search history.

(56) References Cited

U.S. PATENT DOCUMENTS 2,805,556 A * 9/1957 Wensan ..... F25D 3/107 62/294
2,898,747 A * 8/1959 Wales ..... F25D 3/107 62/294
3,648,729 A * 3/1972 Balkany ..... F16K 15/044 137/533.13
4,054,037 A * 10/1977 Yoder ..... F25D 3/107 62/224
4,288,996 A * 9/1981 Roncaglione ..... F25D 3/14 137/67
5,845,501 A * 12/1998 Stonehouse ..... A23L 3/003 62/62
5,966,961 A * 10/1999 Ziggiotto ..... F25D 31/005 62/198
6,145,333 A * 11/2000 Richmond ..... A47F 3/0439 219/385
6,434,961 B2 * 8/2002 Richmond ..... A47F 3/0439 219/385
7,146,826 B1 * 12/2006 Schlosser ..... F25D 31/007 62/457.9
7,347,055 B2 * 3/2008 Lucas ..... F25D 31/007 62/457.4
9,671,155 B2 * 6/2017 Delgadillo ..... F25D 31/00
2003/0074903 A1 * 4/2003 Upadhye ..... A47J 36/2438 62/3.3
2008/0245803 A1 * 10/2008 Angelidis ..... A47J 41/0038 220/592.17
2009/0056369 A1 * 3/2009 Fink ..... F25D 17/02 62/457.4
2016/0209112 A1 * 7/2016 Bayless ..... F25D 7/00

* cited by examiner

*Primary Examiner* — Frantz F Jules
*Assistant Examiner* — Lionel Nouketcha
(74) *Attorney, Agent, or Firm* — Salter & Michaelson

(57) ABSTRACT

A cooling or freezing device which includes a helical coil into which a compressed gas is forced; a cylindrical chamber that is disposed adjacent to the helical coil; and an insulating sleeve. The coil is formed in a cylindrical form and enclosed within the insulating sleeve, while the insulating sleeve is constructed and arranged for receiving a bottle or can for cooling. A compressed gas cylinder is disposed within the cylindrical chamber; and an actuation member is coupled with the cylindrical chamber and constructed and arranged to selectively expel the compressed gas from the compressed gas cylinder to the helical coil.

6 Claims, 4 Drawing Sheets

PORTABLE COOLING DEVICE

RELATED CASES

Priority for this application is hereby claimed under 35 U.S.C. § 119(e) to commonly owned and U.S. Provisional Patent Application No. 62/575,831 which was filed on Oct. 23, 2017 and which is incorporated by reference herein in its entirety.

FIELD OF THE INVENTION

The present invention relates in general to a portable cooling device that is particularly adapted to provide enhanced cooling of a koozie.

BACKGROUND OF THE INVENTION

The standard koozie is a fabric or foam sleeve that is meant to thermally insulate a beverage container such as a can or bottle. Although they may provide some insulating qualities, they are not effective over any substantial period of time.

Accordingly, it is an object of the present invention to provide a portable cooling or freezing koozie construction that allows the user to maintain beverages in a can or bottle at a sustainable cool level.

SUMMARY OF THE INVENTION

In accordance with the present invention the portable cooling koozie, also identified as a "FreeZee", is comprised of a coil arrangement into which a compressed gas is forced from a cylinder. This coil is in a cylindrical or helical form and may be enclosed within an insulating material. A cylinder chamber is disposed adjacent to the coil to hold the cylinder. At the top of the cylindrical chamber there is provided a screw cover that is used to compress the cylinder against a pin so as to puncture the cylinder and allow the compressed gas to enter the coils. This coil arrangement provides a cooling effect. Particularly in combination with an outer insulating sleeve, this arrangement is highly effective in maintaining a cool state of any bottle or can that is inserted inside of the coil construction. In addition to the main cooling device there may also be provided an auxiliary tank that can be coupled with the device so as to enable a number of devices to be re-charged.

In accordance with the present invention there is provided a cooling or freezing device particularly adapted for use with a koozie and which is comprised of a coil arrangement into which a compressed gas is forced from a cylinder, said coil being formed in a cylindrical form and enclosed within an insulating material for receiving a bottle or can.

In accordance with other aspects of the present invention further including a cylinder chamber disposed adjacent to the coil to hold the cylinder; wherein the top of the cylindrical chamber includes a screw cover that is used to compress the cylinder against a pin so as to puncture the cylinder and allow the compressed gas to enter the coil; in combination with an outer insulating sleeve, this arrangement is highly effective in maintaining a cool state of any bottle or can that is inserted inside of the coil construction; further including a cylinder chamber disposed adjacent to the coil to hold the cylinder, and a male/female coupler that allows the cylinder chamber to be de-coupled from the coil arrangement; wherein the top of the cylindrical chamber includes a screw cover that is used to compress the cylinder against a pin so as to puncture the cylinder and allow the compressed gas to enter the coil; wherein the coil arrangement is in a helical form and the insulating material forms a cylindrical outer sleeve that is disposed about the coil arrangement; further including an outer layer that is disposed over the cylindrical outer sleeve and that has an outer surface onto which an inscription can be made; in combination with a large externally disposed tank, a coupler at a base of the coil arrangement and a hose connectable between the external tank and the base coupler.

In accordance with the present invention there is also provided a cooling or freezing device which is comprised of a helical coil into which a compressed gas is forced; a cylindrical chamber that is disposed adjacent to the helical coil; and an insulating sleeve. The coil is formed in a cylindrical form and enclosed within the insulating sleeve, while the insulating sleeve is constructed and arranged for receiving a bottle or can for cooling; a compressed gas cylinder that is disposed within the cylindrical chamber; and an actuation member coupled with the cylindrical chamber and constructed and arranged to selectively expel the compressed gas from the compressed gas cylinder to the helical coil.

In accordance with still other aspects of the present invention the cylindrical chamber is removable from the helical coil; the top of the cylindrical chamber supports the actuation member and the actuation member includes a screw cover that is used to compress the cylinder against a pin so as to puncture the compressed gas cylinder and allow the compressed gas to enter the helical coil; further including an outer layer that is disposed over the cylindrical outer sleeve and that has an outer surface onto which an inscription can be made; further including a male/female coupler that allows the cylinder chamber to be de-coupled from the coil arrangement; wherein the top of the cylindrical chamber supports the actuation member and the actuation member includes a screw cover that is used to compress the cylinder against a pin so as to puncture the cylinder and allow the compressed gas to enter the helical coil; wherein the insulating material forms a cylindrical outer sleeve that is disposed about the helical coil; further including an outer layer that is disposed over the cylindrical outer sleeve and that has an outer surface onto which an inscription can be made, in combination with a large externally disposed tank, a coupler at a base of the coil arrangement and a hose connectable between the external tank and the base coupler.

In accordance with further aspects of the present invention there is provided a cooling or freezing device for holding a bottle or can and used in combination with a large storage tank that contains a compressible gas used for cooling, said cooling or freezing device comprised of a helical coil into which the compressed gas is forced; a cylindrical chamber that is disposed adjacent to the helical coil; an insulating sleeve; said coil being formed in a cylindrical form and enclosed within the insulating sleeve, said insulating sleeve constructed and arranged for receiving the bottle or can for cooling; a coupler at a base of the helical coil and a hose connectable between the external tank and the base coupler; wherein the coupler include a one way valve that only allows fluid to flow into the helical coil.

DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
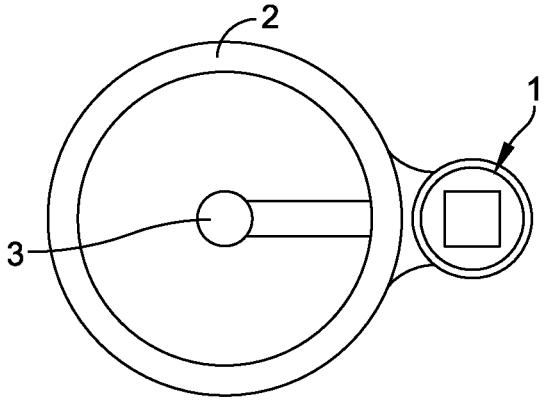
FIG. 1 is a top view of the coil and cylinder chamber of the present invention.

The "FreeZee" is a portable freezing or cooling Koozie that allows the user to keep beverages cold in a portable system. The unit can be encased in an outer-shell using any material, preferably an insulating material. Alternatively, the coil also can be kept exposed, with a safety handle used to protect the user. This unique idea will revolutionize the hydration market by adding a new dimension to "keeping your beverage cold". The device illustrated in the drawings provides a cooling or freezing effect by way of the coils to ensure a desired cool temperature. The following represent the various reference numbers that are employed in the drawings.

Figure 2:
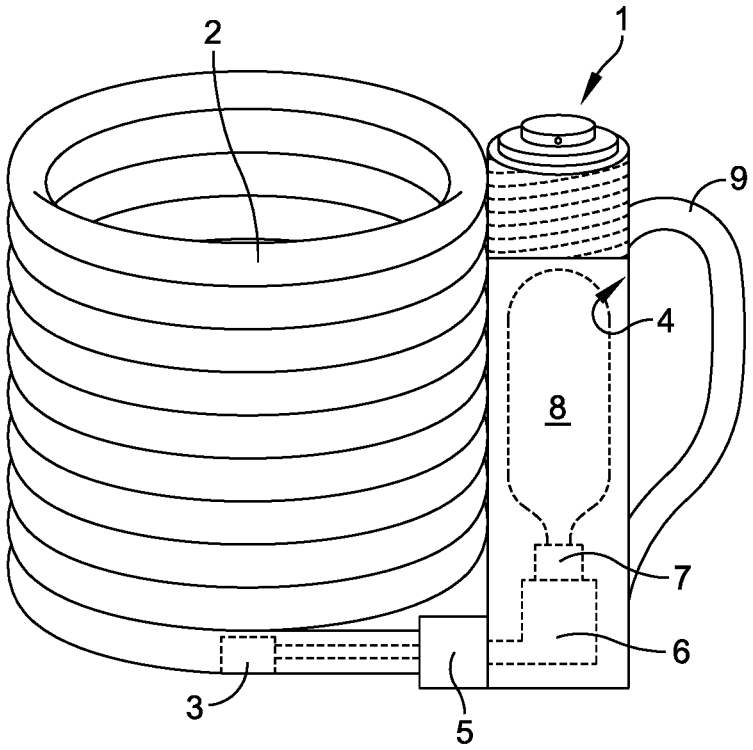
FIG. 2 is a side elevation view of the device of FIG. 1 illustrating the various components.

Reference number 1 is a screw cover that is used to compress a compressed gas cylinder 8 as the cover is tightened compressing it into the pin 7 that will puncture the cylinder 8 and allow the compressed gases to enter the coil 2. In FIG. 2, although it is not illustrated, the bottle or can that is to be cooled would be inserted inside of the coil member 2. In FIG. 2, the compressed gas cylinder 8 is shown disposed within the cylinder chamber 4.

Reference number 2 is the coil that when the compressed gas is forced through will freeze the said coil. A double coil construction can also be used where there is an interior coil that freezes a liquid that is injected in a larger outer coil. The coil may also be encased in any outer sleeve. The outer sleeve can have various designs on it to form a cooling element.

Reference number 3 is a compression fitting that allows a compressed gas to come out at a certain psi. Also, optionally it can be used with CO2 to carbonate the liquid.

Reference number 4 describes the cylinder chamber that holds the cylinder 8 and that also can be constructed with a handle that is schematically illustrated at 9 in FIG. 2.

Figure 3:
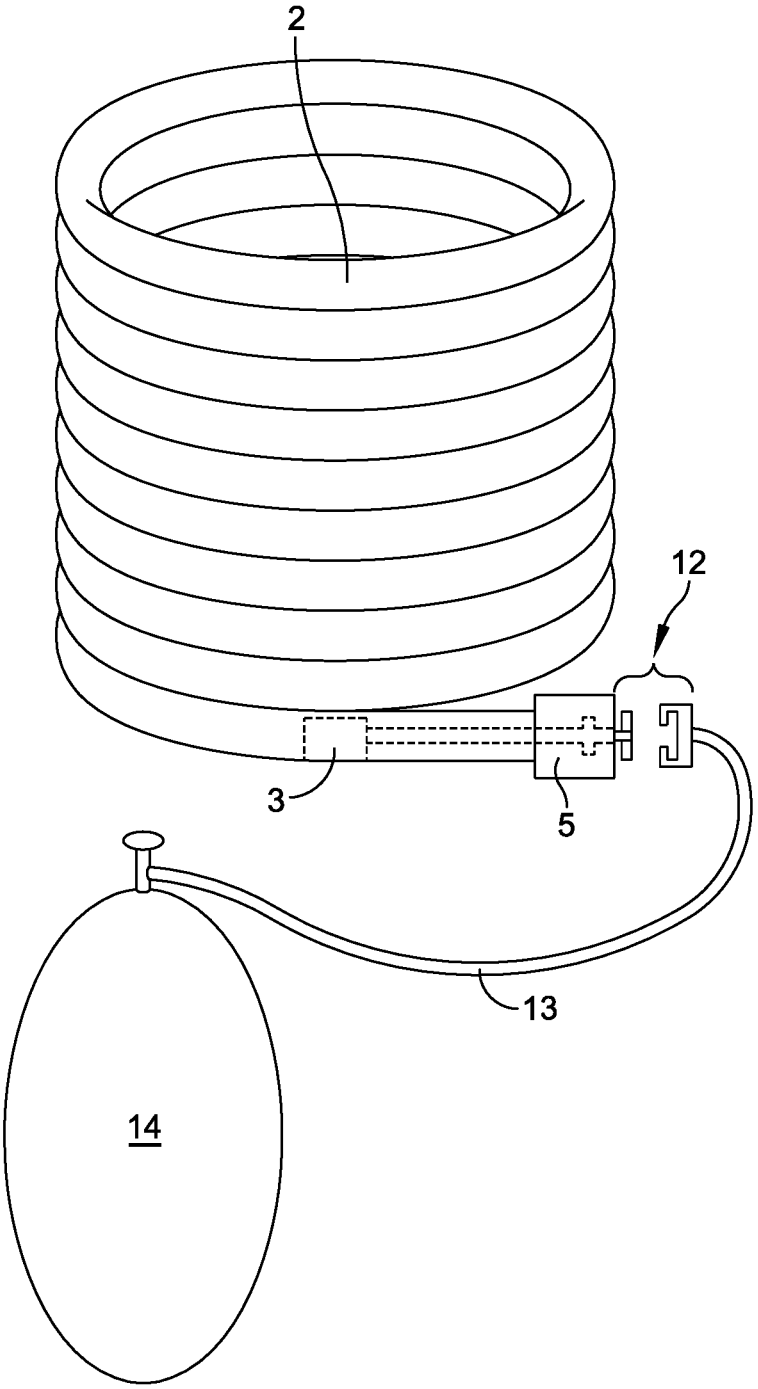
FIG. 3 is an illustration of using a larger fill tank system for applying a cooling fluid to the coil.

Reference number 5 is a male connection coupling that allows it to be interchanged with the cylinder chamber 4 to be portable or to remove the chamber 4 and use a larger fill system, as shown in FIG. 3. This makes the unit more universal for large retailers as well as a portable unit for home use.

Reference number 6 is the female connection coupling that is used in combination with the male connection coupling 5 to complete the system and make the structure universal.

Reference number 7 is the pin that is used to puncture the cylinder. The screw cover 1 compresses the cylinder against the pin 7 to break a seal of the cylinder and allow gases to be expelled into the coil 2.

Reference number 8 is the cylinder that the compressed gas is stored in. By providing a cylinder and actuation member in the form of a cover 1, this allows the device to be portable and allows the freeze coil to be activated at any time or location.

Reference number 12 illustrates a coupling of the hose with the larger tank 14.

Reference number 13 is the hose that connects the tank 14 with the coupling 12.

Reference number 14 illustrates the larger storage tank.

Figure 4:
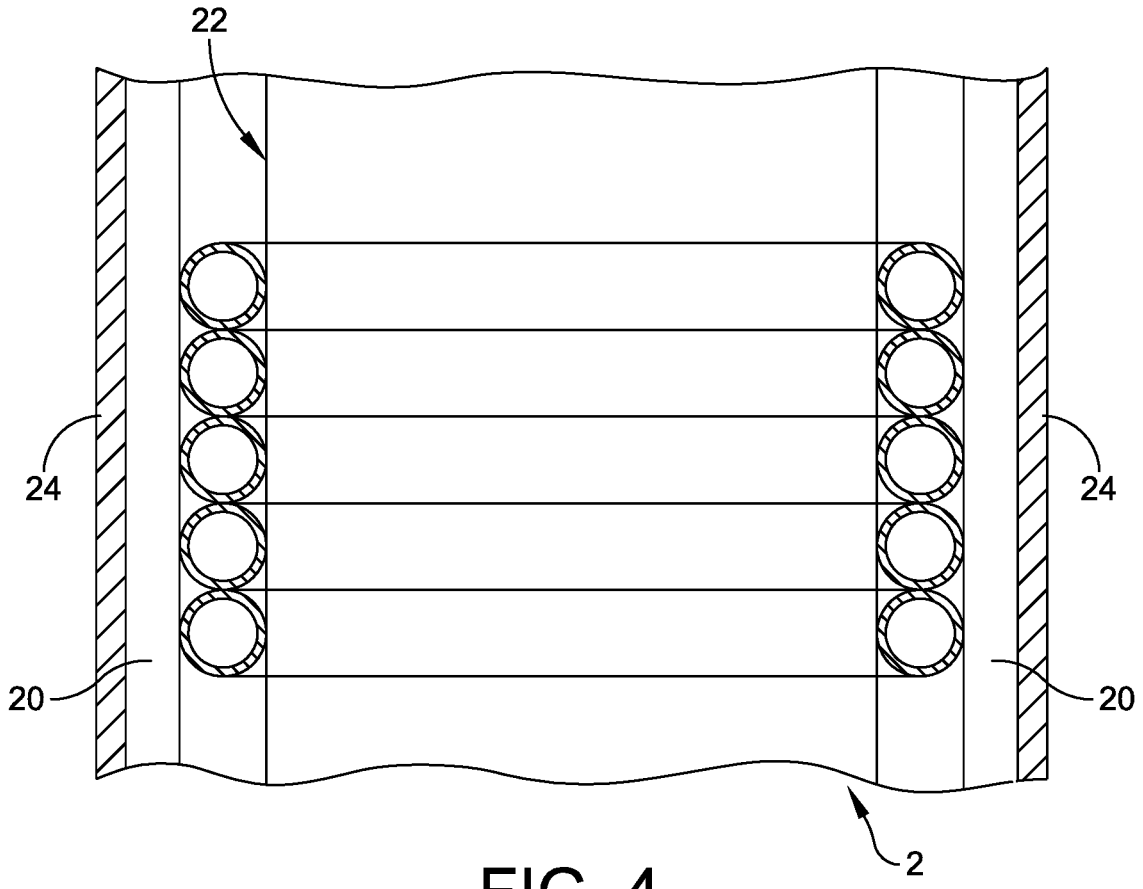
FIG. 4 is a fragmentary view showing further details of the coil structure including showing the inner bottle or can.

As indicated before the drawings illustrate a portable freezing or cooling Koozie that allows the user to keep beverages cold in a portable system. Further details of the coil are found in FIG. 4 which illustrates a portion of the coil structure at 2. Also illustrated in FIG. 4 is an outline of a can or bottle that is disposed within the coil as shown at 22 in FIG. 4. FIG. 4 also shows the coil 2 encased in an outer-shell 20 using any material, preferably an insulating material such as a foam material that has insulating properties. The outer foam sleeve is also illustrated as having an outer layer 24 for containing the foam material and that may be constructed so that a design can be provided on its outer surface. The device illustrated in the drawings provides a cooling or freezing effect by way of the coils to ensure a desired cool temperature.

The container 8 may be readily compressed and maybe in a bellows form so that it can release the cooling gas in a progressive manner as the screw cover 1 is turned. The entire cylinder chamber 4 may be readily de-coupled from the coil structure (via couplers 5, 6) so that the container 8 can be replaced in the chamber 4 after the bottle 8 is depleted. The compression fitting 3 controls the pressure level of the fluid entering the coil structure 2. The embodiment shown in FIG. 3 uses an external larger tank 14 that can feed fluid to the coupler 12 and from there into the coil structure 2. This arrangement allows a multitude of devices to be readily re-filled. For this purpose the coupler 12 may include a one way valve that only allows fluid to flow into the coil structure.

Figure 5:
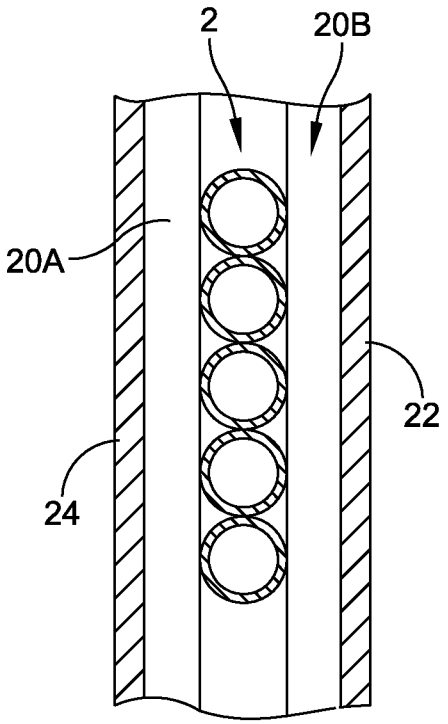
FIG. 5 is a further fragmentary view of a construction wherein the coil structure is completely encased with an insulating layer.

FIG. 5 is a further fragmentary view of a construction wherein the coil structure is completely encased within an insulating layer. FIG. 5 shows the coil structure 2 being completely encased by the foam material at 20A and 20B. FIG. 5 also illustrates the can wall at 22 containing the beverage to be cooled. An outer layer 24 is also shown and upon which a design can be made on an outer exposed surface thereof. Although FIG. 5 only shows a fragmentary part of the structure, the entire coil structure is intended to be surrounded by the insulating material (foam rubber or Styrofoam). The result is that the can wall rests against the inner foam 20B while the outer foam material covers all around the coil structure 2.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A cooling or freezing device for cooling a bottle or a can, the device comprising:

a coil arrangement;

a cylinder chamber into which a cylinder comprising compressed gas is provided; wherein the uppermost surface of the cylinder chamber includes a cylindrical screw cover that is used to compress the cylinder against a pin so as to puncture the cylinder and allow the compressed gas to enter the coil arrangement, said screw cover being fastened by threads to the inner surface of the cylinder chamber, said screw cover comprising a cylindrical portion that protrudes upwards from the uppermost surface of the cylinder chamber;

said coil arrangement is configured to receive compressed gas from the cylinder, said coil arrangement being formed in a cylindrical form, wherein adjacent coil portions of said coil arrangement are in direct contact with each other;

a cylindrical insulating sleeve that completely encases the coil arrangement, said sleeve made of foam material, said sleeve arranged for receiving the bottle or can for cooling or freezing; wherein when the bottle or can is received by the sleeve, the sleeve is disposed between the bottle or can and the coil arrangement;

a coupler provided at a base of the coil arrangement, said coupler mounted on the outer surface of the cylinder chamber, said coupler configured to de-couple the cylinder chamber from the coil arrangement, wherein the coupler includes a one way valve that only allows gas to flow into the helical coil.

2. The cooling or freezing device according to claim 1, wherein the coupler includes a male coupler and a female coupler that allows the cylinder chamber to be de-coupled from the coil arrangement.

3. The cooling or freezing device according to claim 1 wherein the coil arrangement is in a helical form.

4. The cooling or freezing device according to claim 3, wherein the cylindrical chamber is removable from the helical coil.

5. The cooling or freezing device according to claim 3 including a cylindrical inner sleeve that is disposed about an interior surface of the helical coil.

6. The cooling or freezing device according to claim 1 and further including an outer layer that is disposed over the cylindrical outer sleeve and that has an outer surface onto which an inscription can be made.

* * * * *